United States Patent [19]

Hornblad

[11] 4,130,326

[45] Dec. 19, 1978

[54] CIGARETTE MERCHANDISER

[75] Inventor: Richard P. Hornblad, Shorewood, Wis.

[73] Assignee: Display Corporation International, Milwaukee, Wis.

[21] Appl. No.: 831,893

[22] Filed: Sep. 9, 1977

[51] Int. Cl.[2] ..... A47F 3/024; A47B 81/00

[52] U.S. Cl. ..... 312/292; 312/42; 312/138 R; 312/218

[58] Field of Search ..... 312/292, 291, 138, 218, 312/42

[56] References Cited

U.S. PATENT DOCUMENTS

| | | | |
|---|---|---|---|
| 681,155 | 8/1901 | Tobey | 312/218 |
| 2,273,151 | 2/1942 | Siegel | 312/218 |
| 2,504,305 | 4/1950 | Cummings et al. | 312/291 |
| 2,793,925 | 5/1957 | Rosen | 312/138 R |
| 2,814,543 | 11/1957 | Siegel | 312/218 |
| 3,175,729 | 3/1965 | Tyte | 312/42 |
| 3,404,929 | 10/1968 | Wright et al. | 312/218 |
| 3,697,148 | 10/1972 | Weber | 312/138 R |
| 3,741,619 | 6/1973 | Dyer et al. | 312/291 |
| 4,007,853 | 2/1977 | Bahneman | 312/42 |

*Primary Examiner*—Victor N. Sakran

[57] ABSTRACT

A plurality of vertical storage bins for packages of cigarettes are located behind a main pivotally mounted door which, when closed, covers all of the cigarette bins. An access door for each of the storage bins is mounted for vertical movement on the main door to selectively expose and close individual bins. A locking bar is supported on the main door to be selectively positioned in locking engagement with each of the access doors or free from the doors to permit movement thereof to expose the packages of cigarettes. A key operated locking arrangement includes a lock plate connected to and movable with the locking bar. The lock plate is selectively engageable by a key operated locking member and when so engaged the lock bar is held in its position engaging the access doors and holding them against movement and also locks the main door closed over the storage bins.

9 Claims, 5 Drawing Figures

Fig. 1
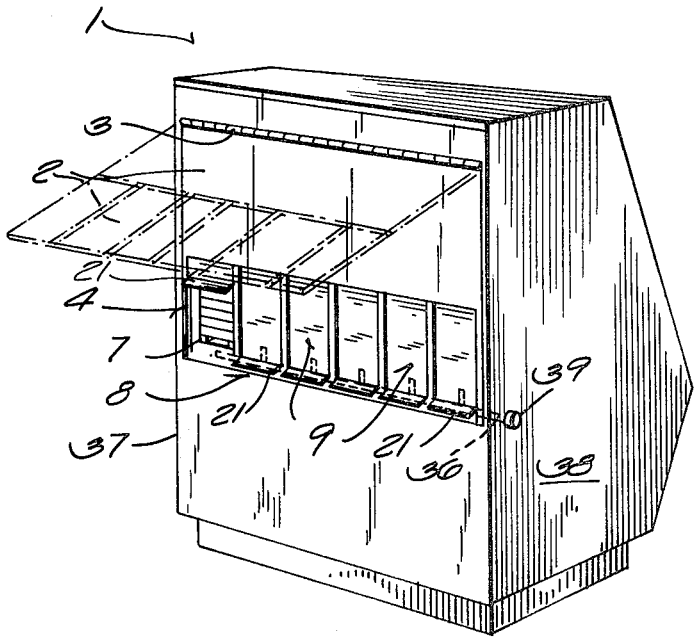
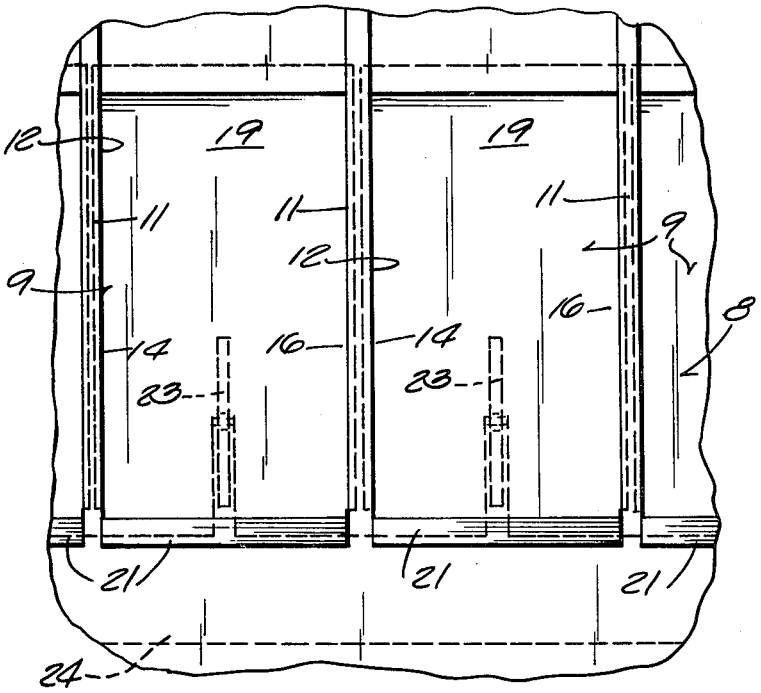
Fig. 2
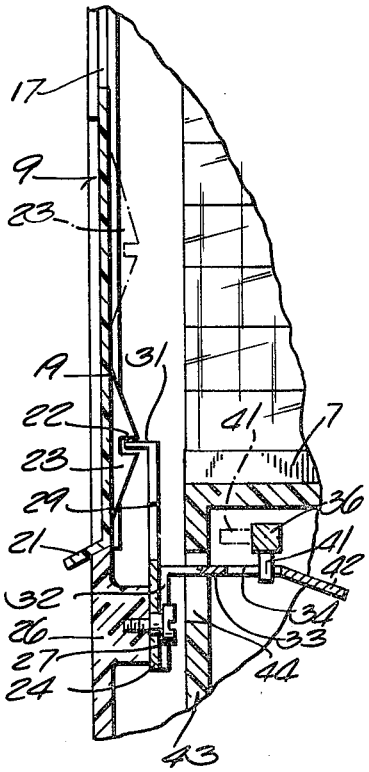
Fig. 3

Fig. 4
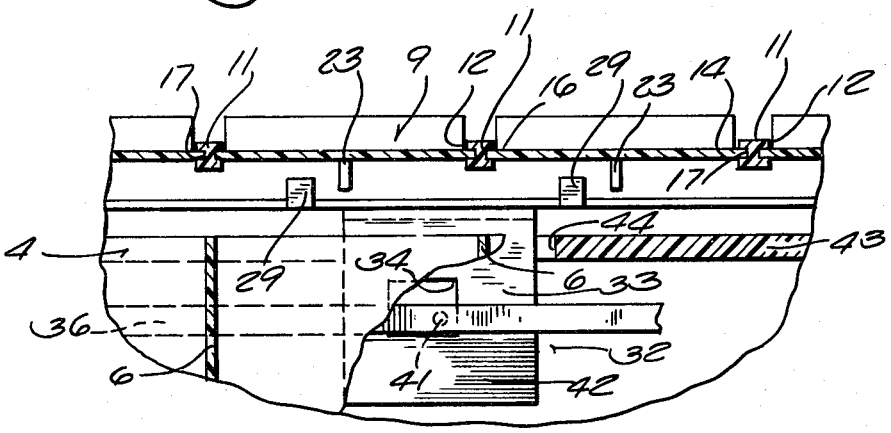
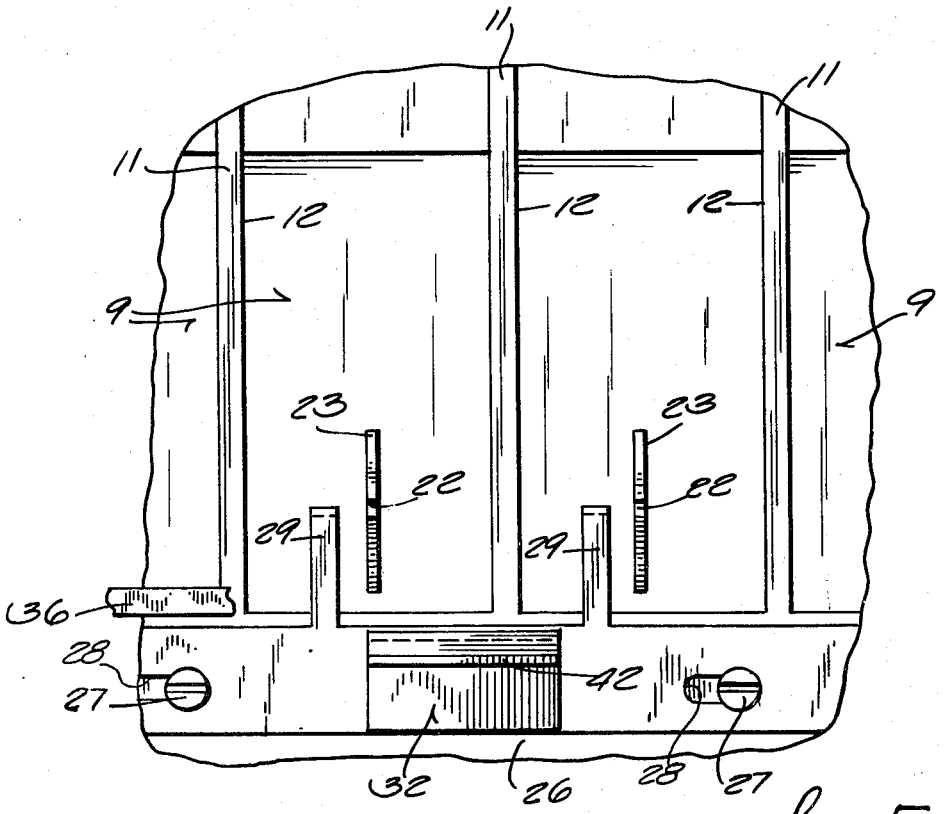
Fig. 5

CIGARETTE MERCHANDISER

BACKGROUND OF THE INVENTION

This invention relates to cigarette-type merchandisers and, more particularly, to an arrangement for rendering packages of cigarettes readily accessible for dispensing and in a manner which permits facile locking against theft.

It has been generally recognized that cigarette merchandisers as used, for example, in gasoline service stations should be exposed to public view and readily accessible for dispensing individual packages, or cartons, of cigarettes to purchasers. The exposure and ready accessibility of cigarette merchandisers in those applications also renders them highly susceptible to theft in as much as they are also readily accessible to the public and cannot be continuously manned or even observed.

SUMMARY OF THE INVENTION

Among the general objects of this invention are to provide a cigarette merchandiser the contents of which can be secured against unauthorized access but which are readily accessible to authorized personnel and to do so with a structure which is relatively simple and economical in construction.

For the achievement of those and other objects, this invention contemplates an arrangement wherein a plurality of storage bins are provided in association with a pivotally mounted door swingable to selectively cover or open all of the bins. Plural access doors, one for each bin, are mounted in registry with each bin and are slidable to expose an individual bin for removal of the articles stored therein. A locking arrangement is provided which is capable of locking both the main door in its closed position and each of the access doors against movement to expose the individual bins. Preferably, the locking arrangement includes a plurality of fingers movable into and out of locking engagement with the access doors and operable when so engaged to hold the access doors against sliding movement and in their closed position. The locking arrangement also preferably includes a plate, which is movable jointly with the fingers, and a key operated pin selectively engageable with the plate and responsive to key operation. When the pin is engaged with the plate, the fingers are held against sliding movement and in engagement with the access doors and the main door is locked in its closed position.

Other objects and advantages will be pointed out in, or be apparent from, the specification and claims, as will obvious modifications of the embodiment shown in the drawings.

DESCRIPTION OF THE DRAWINGS

FIG. 1 is a perspective view of a unit embodying this invention;

FIG. 2 is an enlarged front view of a portion of the unit of FIG. 1;

FIG. 3 is a cross sectional view taken along line 3—3 of FIG. 2;

FIG. 4 is a top view of the assembly illustrated in FIG. 3; and

FIG. 5 is a rear view of the assembly illustrated in FIG. 3.

DESCRIPTION OF THE PREFERRED EMBODIMENT

With particular reference to the drawings, a cigarette merchandiser 1 is conventionally adapted to be supported in an upright position. As an example, merchandisers of this type may be located adjacent a service island of a gasoline service station or inside or outside of a service station office whichever is most accessible. Many times purchasers of gasoline also wish to purchase cigarettes and thus the cigarettes must be readily accessible to the service station attendant. For that reason, the merchandisers are usually located in the most accessible areas. Because of the nature of the gasoline service station business, these merchandisers cannot be continuously manned nor is it possible for the attendant to continuously keep it in view. This then raises the problem of unauthorized access to the merchandiser and possible theft. This invention is concerned with that problem and will be discussed as a merchandiser for individual packages of cigarettes in a service station environment but it should be appreciated that other articles could be dispensed and in connection with other businesses.

The merchandiser includes a main door 2 which has a pivotal connection 3 to the principal body of the merchandiser. The door is swingable about its pivotal mount 3 between a closed position concealing the interior of the merchandiser and an open position exposing the interior.

Door 2 is generally planar and can carry suitable advertising copy describing the contents of the merchandiser.

The interior of the body of the merchandiser is provided with a plurality of vertical bins 4 defined by spaced vertical walls 6. The spacing between the walls 6 in the illustrated embodiment is such as to comfortably accommodate a cigarette package laying on its side with one of its ends exposed to the front of the merchandiser, i.e. toward the main door 2. With the door 2 in the open position, a different brand of cigarettes can be loaded into each of the individual bins. It should be appreciated that the merchandiser concept of this invention could also be used to dispense cartons of cigarettes by increasing the depth of the merchandiser and/or adjusting the spacing between the walls 6 accordingly.

Shoulders 7 are located in each of the bottom corners of the bins and the lowermost of the cigarette packages in the bins will rest on these shoulders. The attendant can place his finger into the space 10 defined between the shoulders to slide out the lowermost pack.

The lower portion 8 of the main door is provided with a plurality of access doors 9. These doors are each supported between spaced walls 11, those walls in turn defining openings 12. One such opening 12, and its associated access door 9, is in registry with each of the bins 4. The opposite edges 14 and 16 of each of the access doors are engaged in grooves 17 of wall 11. Thus, the access doors can slide vertically to selectively close and expose openings 12 and in turn selectively close and expose the bins 4 and the cigarette packages stored therein.

Each of the access doors includes an elongated planar section 19 and a lower finger portion 21 disposed at an angle to the planar portion 19. Copy illustrating the brand of cigarette stored in the bin behind a particular access door can be attached to the planar portion 19.

The angled finger portion 21 provides means by which the attendant can raise the access door to expose the cigarette packages.

A notch 22 is provided on the back side of each of the access doors, i.e. back side in the sense that it is disposed inside of the merchandiser and faces its respective bin when the main door 2 is in its closed position. Notches 22 are arranged at the apex of a generally triangular projection 23 extending laterally from panel 19. The reasons for the angular configuration of that projection and locating the notch 22 at the apex thereof will be apparent from the discussion to follow.

An elongated strip 24 is slidably attached to the inside surface of the lower end 26 of door 2. The slidable mounting is provided by a series of screws 27 which are threaded into end 26 of door 2 and extend through elongated slots 28 in the strip 24. Strip 24 can then be moved to the left or the right as viewed in FIG. 5 within the limits defined by the length of slots 28.

As is perhaps best illustrated in FIG. 3, a plurality of fingers 29 are formed as an integral part of strip 24. The free ends of fingers 29 are turned at right angles to the main portion 30 of the finger to define tabs 31. Fingers 29 are made of a generally resilient metallic material and tabs 31 are sized to fit into notches 22 in respective ones of the projections 23.

Projections 23 are of limited width relative to the overall width of the access doors 9 and when the strip 24 is positioned such that screws 27 are located to the extreme right of slots 28, a tab 31 is positioned in a notch 22 on each of the access doors 9. In that position, tabs 31 prevent vertical movement of the access doors and the doors cannot be moved vertically to expose the cigarette packages in the various bins.

In order to lock the strip 24 in its position wherein the access doors are locked closed, a selective locking arrangement is associated with the strip 24. In the preferred embodiment, this locking arrangement takes the form of a plate 32 having a flange 33 welded, or otherwise suitably fixed, to strip 24. The plate projects from strip 24 into the interior of the merchandiser when the main door is closed. A rectangular slot 34 is provided in the plate.

The locking arrangement further includes a rod 36 pivotally supported at both ends from the side walls 37 and 38 of the merchandiser. The rod is associated with the tumbler of a conventional key operated locking mechanism 39 at one side of the merchandiser. A pin 41 is supported on rod 36 in an area to selectively register with slot 34 in plate 32. Pin 41 can be rotated between the full line and dotted line positions illustrated in FIG. 3 by operation of the key operated tumbler 39. The slot 34 is elongated front to back sufficient to permit the pin to move between its full and dotted line positions. When the pin is in the full line position and fingers 29 are engaged in notches 22, the pin is in engagement with the left end of slot 34 and will prevent further movement of slide 24 to the right thereby positively holding the tabs 31 in notches 22.

By providing the plate 32 on the main door 2, the locking arrangement consisting of the key operated tumbler 39, plate 32 and pin 41 also locks the main door in its closed position. Thus, an overall lock arrangement is provided which locks both the access doors and the main door in a closed position so that access to the interior of the merchandiser can only be had by authorized personnel operating the key operated tumbler 39.

It will be noted that plate 32 moves into and out of an opening 42 provided in the lower wall 43 defining the lower ends of bins 4. Rod 36 and pin 41 are located behind wall 43.

It will also be noted that with the notches 22 in projection 23 being provided at the apex of the generally triangular member, the walls of that member which slope from the notch back toward the access door can act as camming surfaces in the event the device is locked while one of the access doors remains in its up position. The access door can be moved down over the tab 31 and the resiliency of fingers 29 will permit the tab to cam back and then move into the notch for proper locking.

Similarly, the free end 42 of plate 32 is angled downwardly to provide a cam surface so that should the pin means 41 be moved to its locking position with the door open, the door will close over the pin with the turned portion 42 providing a camming action to permit the pin to be located within slot 34.

With this arrangement, the gasoline station attendant can lock the cigarette merchandiser when he is providing service functions away from the merchandiser. Should one of the customers desire cigarettes, the attendant need only insert the key in the tumbler, release the pin means 41 from slot 34, raise the main door slightly, and slide the slide bar 24 to free the access doors. He may then manipulate the access doors as required to remove the desired cigarette package. When the area near the merchandiser is being manned, the locking arrangement may be left unlocked so that only the access doors need be manipulated to remove cigarettes.

Although but one embodiment of the present invention has been illustrated and described, it will be apparent to those skilled in the art that various changes and modifications may be made therein without departing from the spirit of the invention or from the scope of the appended claims.

I claim:

1. A merchandiser as described comprising, in combination, means defining a plurality of spaced apart bins, housing means defining an enclosure for said bins, a plurality of access doors, means supporting said access doors on said housing means with one of said access doors positioned in registry with each of said spaced apart bins and also for sliding movement relative to said bins so that said access doors are selectively movable to close said bins and open said bins for access from the exterior of said merchandiser, locking means comprising a plurality of locking fingers and supported on said housing means, said locking fingers being mechanically interconnected so that all of said locking fingers are jointly movable selectively between a first position wherein said locking fingers are each engaged with a respective one of said access doors and a second position free of engagement from said access doors to permit said sliding movement of said access doors, and means defining a locking arrangement connected to said locking means and including a key operated portion exposed externally of said merchandiser and a locking portion disposed interiorally of said merchandiser and selectively movable between a first position in locking engagement with said locking means to hold said locking fingers in said first position and a second position out of engagement with said locking means and freeing said locking fingers for sliding movement to said second position, wherein each of said access doors includes means defining a notch projecting into the interior of said merchandiser when said main door is in its closed position, and said locking fingers comprise a plurality of tabs selectively engageable in respective ones of said notches when said locking fingers are in said first position and free of said notches when said locking fingers are in said second position.

2. The merchandiser of claim 1 wherein said housing means includes a main door pivotally mounted for swinging movement selectively to close over said bin and open said bins, and said access doors are slidably mounted on said main door.

3. The merchandiser of claim 2 wherein said bins extend vertically and are spaced horizontally relative to each other, and said access doors are supported for vertical movement on said main door and are also spaced horizontally conforming to the horizontal spacing of said bins.

4. The merchandiser of claim 1 wherein said tabs are provided on and movable with vertically extending resilient fingers and said tabs project horizontally from said fingers, and said notches are each provided in a projection extending laterally from each of said access doors, each of said notches being spaced outwardly from said access doors and said projection sloping angularly from said notches to respective ones of said access doors so that said projections can act as camming surfaces when said access doors are moved to position said notch in registry with a respective one of said tabs.

5. The merchandiser of claim 4 wherein said locking arrangement includes a sliding member interconnecting said fingers and including means defining a projection on said sliding member and a slot in said projection, and including pin means connected to an elongated rod operatively connected to said key operated portion, said pin means located in the area of said slot and movable between a first position free from the confines of said slot and a second position located within said slot, said pin means being engageable with the walls defining said slot when said locking fingers are in said first position so that said pin means will hold said locking fingers in said first position.

6. A merchandiser, comprising in combination, means defining a housing, a plurality of vertical walls positioned within said housing and spaced horizontally from each other to define a plurality of vertically extending bins within the interior of said housing, a main door, means connecting said main door to said housing for pivotal movement between a first position closing over said bins and a second position opening said bins, means defining an opening in said main door registering with the lower portion of each of said bins, a plurality of access doors, one of said access doors being in alignment with each of said bins, means supporting said access doors on said main doors for sliding vertical movement relative to said main door opening to selectively close and open said opening so that said access doors can selectively close said bins and open each of said bins for individual access thereto, a plurality of resilient locking fingers, means connecting said locking fingers to said main door, means interconnecting said locking fingers for joint movement thereof, one of said locking fingers being associated with each of said access doors and each locking finger including an elongated vertical portion adapted to extend along each of said access doors and a turned tab portion projecting at an angle from said elongated portion toward a respective one of said access doors, means defining a notch on each of said access doors and opening into the interior of said cigarette merchandiser when said main door is closed, said resilient fingers similarly located on the inside of said main door and said turned tabs being jointly slidable relative to said main door between a first position wherein each of said tabs is located in engagement in a respective one of said notches and a second position wherein said turned tabs are spaced from and free of engagement with said notches, and a locking arrangement including a key operated portion exposed to the exterior of said cigarette merchandiser and associated with said resilient fingers to lock said resilient fingers in said first position.

7. The cigarette merchandiser of claim 6 wherein said locking arrangement is further operative to lock said main door in its closed position.

8. The merchandiser of claim 6 wherein said tabs are provided on and movable with vertically extending resilient fingers and said tabs project horizontally from said fingers, and said notches are each provided in a projection extending laterally from each of said access doors, each of said notches being spaced outwardly from said access doors and said projection sloping angularly from said notches to respective ones of said access doors so that said projections can act as camming surfaces when said access doors are moved to position said notches in registry with a respective one of said fingers.

9. The merchandiser of claim 8 wherein said means connecting said locking fingers includes a sliding member, wherein said locking arrangement includes means defining a projection on said sliding member and including a slot defined in said projection, and including pin means connected to an elongated rod operatively connected to said key operated portion, said pin means located in the area of said slot and movable between a first position free from the confines of said slot and a second position located within said slot, said pin means being engageable with the walls defining said slot when said fingers are in said first position so that said pin means will hold said fingers in said first position.

* * * * *